US007894729B2

(12) United States Patent
Cho et al.

(10) Patent No.: US 7,894,729 B2
(45) Date of Patent: Feb. 22, 2011

(54) MICROCHIP AND METHOD FOR REPAIRING CARTRIDGE

(75) Inventors: Myung-Lae Cho, Daejeon (KR); Young-Su Park, Daejeon (KR); Young-Seok Kwon, Gunpo (KR); Sung-Wook Kim, Daejeon (KR)

(73) Assignee: Park & OPC Co. Ltd., Chungcheonbuk (KR)

( * ) Notice: Subject to any disclaimer, the term of this patent is extended or adjusted under 35 U.S.C. 154(b) by 727 days.

(21) Appl. No.: 11/641,631

(22) Filed: Dec. 19, 2006

(65) Prior Publication Data

US 2007/0147853 A1 Jun. 28, 2007

(30) Foreign Application Priority Data

Dec. 28, 2005 (KR) ..... 10-2005-0132273

(51) Int. Cl.
*G03G 15/00* (2006.01)

(52) U.S. Cl. ..... 399/12

(58) Field of Classification Search ..... 399/12
See application file for complete search history.

(56) References Cited

U.S. PATENT DOCUMENTS 5,995,774 A 11/1999 Applegate et al.
6,397,017 B1 * 5/2002 Sakai et al. ..... 399/27
7,286,774 B1 * 10/2007 Miller et al. ..... 399/12

* cited by examiner

*Primary Examiner*—David M Gray
*Assistant Examiner*—Ruth N Labombard
(74) *Attorney, Agent, or Firm*—Blakely, Sokoloff, Taylor & Zafman LLP

(57) ABSTRACT

A microchip for making a cartridge to be compatible with an imaging device is disclosed. The microchip can be used for various cartridges such as toner cartridges, ink cartridges, and so on, and includes a pair of electrodes which receive electronic signal from an imaging device, wherein the electronic signal includes clock signal and data signal; and a microprocessor which detects (a) a clock generation time and (b) a clock frequency from the electronic signal received by the electrodes, determines the type of cartridge which is compatible with the imaging device, operates a communication program according to the determined type of cartridge, and communicates with the imaging device with the communication program.

6 Claims, 2 Drawing Sheets

MICROCHIP AND METHOD FOR REPAIRING CARTRIDGE

FIELD OF THE INVENTION

This invention relates to a microchip for repairing cartridge. More particularly, this invention relates to a microchip for repairing cartridge, which can be used for various cartridges such as toner cartridges, ink cartridges, and so on, for making the cartridges to be compatible with an imaging device.

BACKGROUNDS OF THE INVENTION

An imaging device, such as a copier, a printer, and so on, uses various disposable cartridges such as a toner cartridge, an ink cartridge, and a drum cartridge. The cartridge has a size and shape which fits into its imaging device. When the cartridge is used up, the cartridge is replaced with a new cartridge. Some printer or copier manufacturers produce a cartridge having the size and shape which is compatible only with their imaging device so that a cartridge of other manufacturers does not work with their imaging device. However, a reusing of a used up cartridge by repairing and/or refilling the used up cartridge can not be prevented by such a method.

Recently, in order to prevent the reusing of a cartridge, some manufacturers mount a microchip (hereinafter, "original chip") on their cartridge. In the microchip, information, which can be utilized only by the manufacturers' imaging device, is memorized. Thus, a cartridge without the microchip does not operate in the manufacturers' imaging device. When a cartridge having the microchip is installed in a printer, the microchip receives power and data from the printer, and carries out communication with the printer, for example, by memorizing or transferring specific information according to the received data. By this communication, the compatibility of the cartridge and the printer is confirmed. The information, which can be memorized or used by the microchip, may include a serial number of a toner cartridge, a manufacturing date, the amount of remaining toner, and so on. For example, U.S. Pat. No. 5,995,774 discloses a method of recording a toner level in a nonvolatile memory mounted on a toner cartridge. In the toner cartridge, when toner is refilled into the reservoir of the toner cartridge, the cooperation of the toner cartridge and the printer is deteriorated, and the toner cartridge does not work with the printer. In a specific example of the patent, the toner level recorded in the memory can not be increased, and the printer works according to the recorded toner level. Therefore, the reusing of the toner cartridge by refilling the toner can be prevented.

SUMMARY OF THE INVENTION

Therefore, it is an object of the present invention to provide a microchip for repairing and reusing various cartridges. It is other object of the present invention to provide a microchip for making a cartridge to be compatible with an imaging device.

To accomplish these and other objects, the present invention provides a microchip for repairing cartridge, comprising: a pair of electrodes which receive electronic signal from an imaging device, wherein the electronic signal includes clock signal and data signal; and a microprocessor which detects (a) a clock generation time and (b) a clock frequency from the electronic signal received by the electrodes, determines the type of cartridge which is compatible with the imaging device, operates a communication program according to the determined type of cartridge, and communicates with the imaging device with the communication program. The present invention also provides a method for repairing cartridge. The method comprises the steps of installing a cartridge, on which a repairing microchip is mounted, in an imaging device, and initializing a main processor of the imaging device; detecting (a) a clock generation time and (b) a clock frequency of an electronic signal transferred from the imaging device; determining a type of cartridge which is compatible with the imaging device from the detected (a) the clock generation time and (b) the clock frequency; and carrying out communication between the microchip and the imaging device with a communication program which corresponds to the determined type of cartridge in order to make the cartridge to be compatible with the imaging device.

DETAILED DESCRIPTION OF THE INVENTION

A more complete appreciation of the present invention, and many of the attendant advantages thereof, will be better appreciated by reference to the following detailed description in conjunction with drawings.

Figure 1:
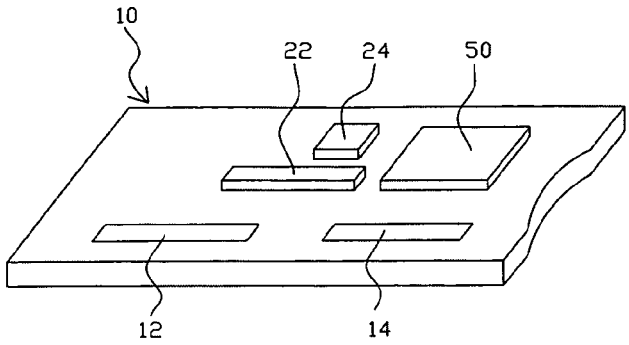
FIG. 1 is a perspective view of a microchip for repairing cartridge according to an embodiment of the present invention.
Figure 2:
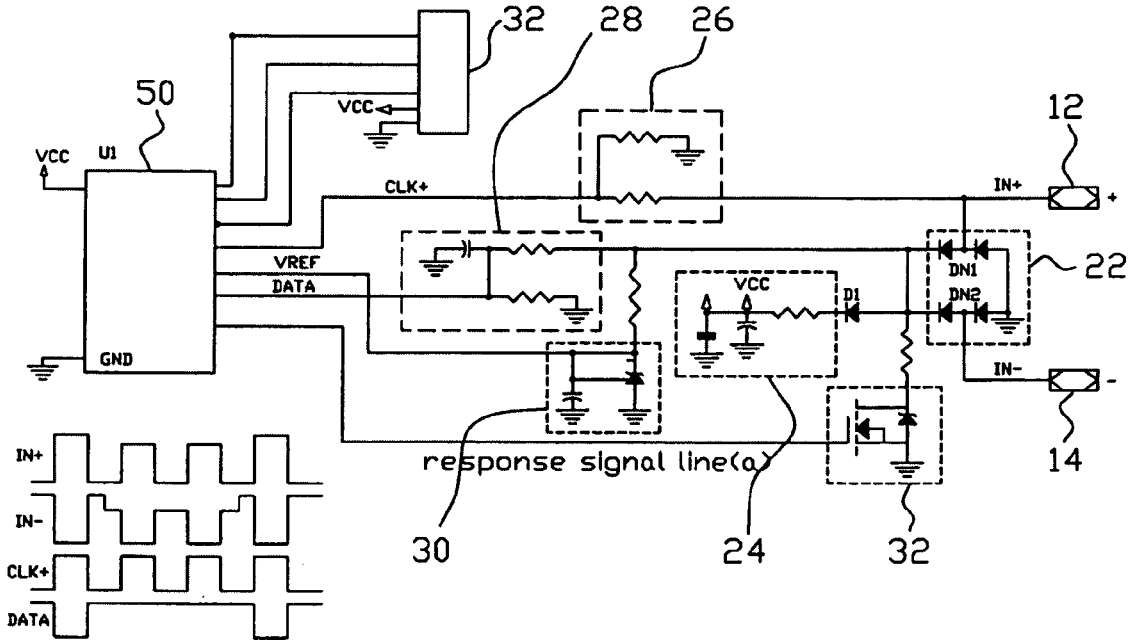
FIG. 2 is a block diagram of a microchip for repairing cartridge according to an embodiment of the present invention.

FIG. 1 is a perspective view of a microchip for repairing cartridge according to an embodiment of the present invention, and FIG. 2 is a block diagram of the microchip. The microchip 10 for repairing cartridge, shown in FIG. 1, can be mounted on various cartridges, such as a toner cartridge, an ink cartridge, a drum cartridge, and so on, and replace an original microchip which makes the cartridge to be compatible with an imaging device. Preferably, the microchip 10 has a shape and structure so that the microchip 10 can be mounted on the cartridge in place of the original microchip. More specifically, the microchip 10 can be mounted on the original microchip position after removing the original microchip from the cartridge. The original microchip communicates with the imaging device, such as a printer, by a predetermined communication protocol, and memorizes information such as the amount of toner remaining in the cartridge, number of printed-papers, the installation date of a toner cartridge, final usage date of a toner cartridge, a serial number of a toner cartridge, a manufacturing date, or so on. The microchip 10 according to an embodiment of the present invention comprises a pair of electrodes 12, 14 which electronically interfaces with an electronic circuit of the imaging device; and a microprocessor 50 which receives the electronic signal transferred from the imaging device and communicates with the imaging device. The microchip 10 may further include various electronic devices 22, 24 for adjusting the size (intensity, amplitude) of the electronic signal from the imaging device or for filtering data signal from the electronic signal.

As shown in FIG. 2, the microchip 10 includes the first electrode 12, the second electrode 14, and the microprocessor 50. The first and second electrodes 12, 14 receive electronic signal from the imaging device, and the electronic signal includes clock signal and data signal. The microprocessor 50 detects (a) a clock generation time and (b) a clock frequency from the electronic signal received by the first and second electrodes 12, 14, and determines the type of cartridge which is compatible with the imaging device. The microprocessor 50 also has at least one communication program for communication between the microchip 10 of the cartridge and the imaging device. Each imaging device transmits clock signal (CLK) of a predetermined frequency to the microchip 10 to communicate with the original microchip which was attached to the cartridge. The clock generation time of the clock signal (CLK) means the time interval between the first time on which the imaging device's operation is initiated and the second time on which the microchip 10 receives the clock signal (CLK). The clock generation time varies according to type of the imaging device. The clock generation time and the clock frequency are measured in advance for each type of cartridge, and the information is memorized in the microprocessor 50.

Accordingly, the microprocessor 50 determines the type of cartridge which is compatible with the imaging device by detecting (a) the clock generation time and (b) the clock frequency from the electronic signal received by the first and second electrodes 12, 14. Then, the microprocessor 50 operates a communication program according to the determined type of cartridge, and communicates with the imaging device with the communication program. By this communication, the imaging device considers "the cartridge having the repairing microchip 10" as a compatible cartridge. For example, the communication between the microprocessor 50 and the imaging device can be carried out by producing a response which is required in the imaging device, and transmitting the produced response to the imaging device through a response signal line (a) of FIG. 2, or by memorizing the response or other information in a memory of the microprocessor 50 in response to the commands from the imaging device. The determined type of cartridge can be recorded in the memory of the microprocessor 50, for examples, in EEPROM (Electrically Erasable Programmable Read-Only Memory). By recording the type of cartridge in the memory, the step of determining the type of cartridge can be omitted when the cartridge is further recycled, reused, or refilled or when the cartridge is reinstalled in the imaging device or when a reset operation is carried out for the imaging device.

Figure 3:
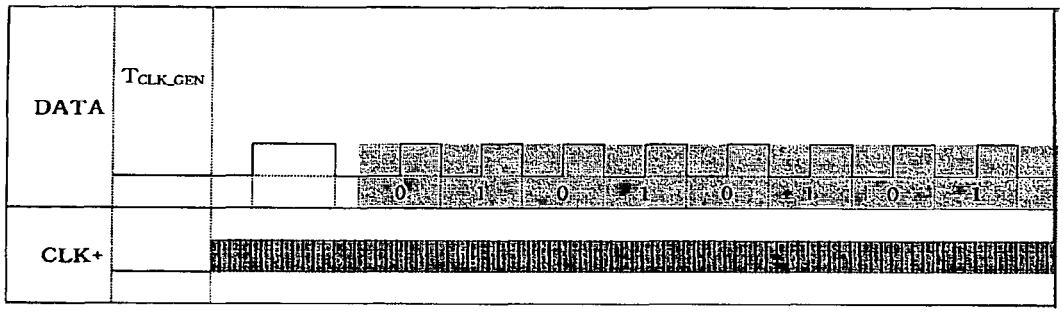
FIG. 3 is a figure for showing an example of clock signal and data signal which is inputted to a microchip according to the present invention.

FIG. 3 is a figure for showing an example of the clock signal (CLK+) and the data signal (DATA) which is inputted to the microchip of the present invention. In FIG. 3, the interval between the vertical clock signals (CLK+) represents the clock frequency. After the power of the imaging device is turned on, namely, after the imaging device's operation is initiated, the time interval at which the microchip 10 receives the clock signal is determined. Namely, the clock generation time ($T_{CLK_GEN}$) in FIG. 3 is determined. For examples, when the imaging device is a black and white HP (Hewlett-Packard) printer, and when the clock generation time is $T_{CLK_GEN1}$, the compatible cartridge is HP4200/HP4300 series toner cartridge. Under this condition, when the clock frequency (interval between clock signals) is $T_{CLK1}$, the compatible cartridge is HP4200 series toner cartridge. When the clock frequency is $T_{CLK2}$, the compatible cartridge is HP4300 series toner cartridge. In case the clock generation time of the imaging device is not $T_{CLK_GEN1}$, when the clock frequency is $T_{CLK3}$, the compatible cartridge is HP1300 series toner cartridge, when the clock frequency is $T_{CLK4}$, the compatible cartridge is HP2300 series toner cartridge, when the clock frequency is $T_{CLK5}$, the compatible cartridge is HP1320 series toner cartridge, and when the clock frequency is $T_{CLK6}$, the compatible cartridge is HP2420 series toner cartridge. When the imaging device is a color printer, and the clock generation time is $T_{CLK_GEN1}$, the compatible cartridge is an image drum cartridge. When the imaging device is a color printer, and the clock generation time is not $T_{CLK_GEN1}$, the compatible cartridge is a toner cartridge. If the clock generation time is $T_{CLK_GEN2}$, the compatible cartridge is a YELLOW color toner cartridge. If the clock generation time is not $T_{CLK_GEN2}$, the compatible cartridge is a MAGENTA, a CYAN, or a BLACK color toner cartridge. As described above, by detecting (a) the clock generation time and (b) the clock frequency, the type of cartridge which is compatible with the imaging device can be determined. Then, a communication program, which corresponds to the type of cartridge, works to perform the communication between the imaging device and the microchip 10.

According to the other embodiment of the present invention, the microprocessor 50 may have information regarding the initial 200 bits data signal, preferably, the initial 30 bits data signal, which is the initial part of the data signal received by the first and second electrodes 12, 14. In this case, the microprocessor 50 also has the information regarding the type of cartridge which corresponds to the initial data signal. Generally, an identification code for the communication between the imaging device and the microchip 10 is in the initial 200 bits data signal. Therefore, by analyzing the initial 200 bits data signal and by using the information in the microprocessor 50, the type of compatible cartridge can be determined, and necessary communication program can be operated. The initial data signal can be used to determine the type of compatible cartridge with or without using (a) the clock generation time and (b) the clock frequency. When the type of compatible cartridge is determined with (a) the clock generation time and (b) the clock frequency, the initial data signal can be used to additionally check or confirm the determined type of compatible cartridge.

As shown in FIG. 2, the microchip 10 according to the present invention may further include a rectifier 22, a voltage generator 24, a clock signal modulator 26, a data signal modulator 28, a reference voltage generator 30, and a microprocessor programming terminal 32. The rectifier 22 filters data signal from electronic signal received by the first and second electrodes 12, 14, and transfers the filtered data signal to the microprocessor 50. The reference voltage generator 30 generates a reference voltage, and provides the reference voltage to the microprocessor 50. The reference voltage is used to discard the data signal which has the smaller amplitude than the reference voltage. Thus, the microprocessor 50 receives and uses data signal having the higher amplitude than the reference voltage. The voltage generator 24 generates an operation voltage (VCC) for the microprocessor 50 and the microprocessor programming terminal 32 by using the electronic signal rectified in the rectifier 22. If the microprocessor 50 and the microprocessor programming terminal 32 are operated with other operation power, the voltage generator 24 is not necessary. The clock signal modulator 26 adjusts the amplitude of the electronic signal transmitted from the imaging device, and thereby adjusts the amplitude of the clock signal (CLK+). The data signal modulator 28 adjusts the amplitude of the data signal (DATA) generated in the rectifier 22. The microprocessor programming terminal 32 is provided for inputting various data to the microprocessor 50 and/or for programming the microprocessor 50. The reference numeral 32*a* represents a response signal modulator for adjusting the amplitude of the response signal which transmitted to the imaging device from the microprocessor 50 through the response signal line (a).

Figure 4:
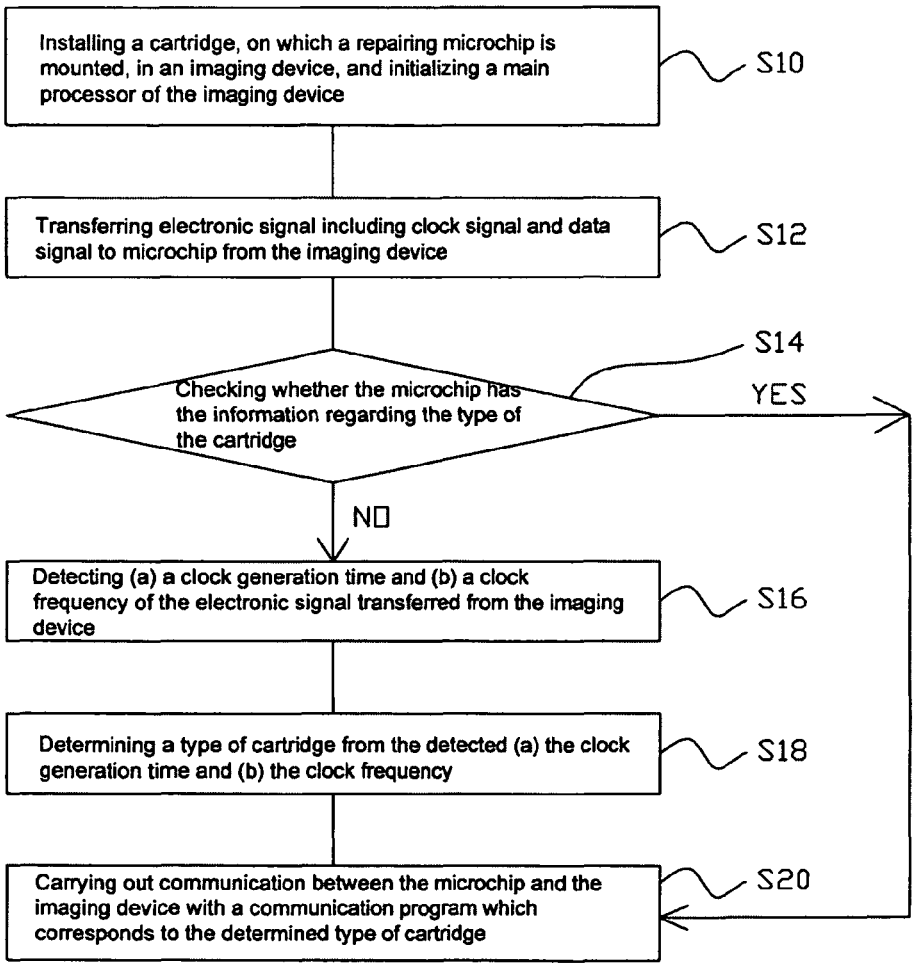
FIG. 4 is a flow chart for illustrating a method for repairing cartridge according to an embodiment of the present invention.

Hereinafter, the operation of the microchip according to an embodiment of the present invention will be explained. As shown in FIG. 4, first of all, a cartridge, on which the repairing microchip 10 is mounted, is installed in an imaging device and the power of the imaging device is turned on to initialize the main processor of the imaging device (S 10). Then, the main processor of the imaging device transfers the electronic signal including the clock signal and the data signal to the microchip 10 (S 12). When the electronic signal is transferred, if necessary, the microchip 10 checks whether the microchip 10 has the information regarding the type of the cartridge, on which the microchip 10 is mounted (S 14). If the microchip 10 does not have the information regarding the type of the cartridge, (a) the clock generation time and (b) the clock frequency of the electronic signal transferred from the imaging device are detected (S 16), and the type of cartridge which is compatible with the imaging device is determined from the detected (a) the clock generation time and (b) the clock frequency by referring the information memorized in the microchip 10 (S 18). When the type of cartridge is determined, the microchip 10 and the imaging device communicate with a corresponding communication program to make the cartridge to be compatible with the imaging device (S 20). In the step of S 14, if the microchip 10 has the information regarding the type of the cartridge, the steps of S 16 and S 18 can be omitted, and the step of S 20 is carried out.

The microchip 10 according to the present invention detects (a) the clock generation time and (b) the clock frequency of the electronic signal provided by the imaging device, and determines the type of compatible cartridge, and selects the communication program for communicating the microchip and the imaging device. Accordingly, the communication between the microchip and the imaging device is properly carried out, and the imaging device recognizes "the installed and repaired cartridge" as a compatible or usable cartridge. The microchip 10 according to the present invention can be mounted on various cartridges, regardless of the type of cartridge, and then the cartridges having the microchip 10 is installed into an imaging device. The microchip 10 automatically determines the type of the cartridge, and operates a corresponding communication program to communicate with the imaging device. Thus, it is not necessary for a user to select a proper microchip for repairing the cartridge and to mount the selected specific microchip on the cartridge. As described above, the microchip according to the present invention can be applied to various types of cartridges and makes the cartridge to be compatible with the imaging device. The microchip according to the present invention can be used for various imaging devices, such as a printer, a copier, and so on, which uses disposable cartridges.

The invention claimed is:

1. A microchip for repairing a cartridge, comprising:

a pair of electrodes which receive electronic signal from an imaging device, wherein the electronic signal includes clock signal and data signal; and a microprocessor which detects (a) a clock generation time and (b) a clock frequency from the clock signal received by the electrodes, determines a type of cartridge which is compatible with the imaging device based on the detected clock generation time and the detected clock frequency, operates a communication program according to the determined type of cartridge, and communicates with the imaging device with the communication program, wherein the determined type of cartridge is recorded in a memory of the microprocessor.

2. The microchip for repairing cartridge according to claim 1, wherein the communication between the microprocessor and the imaging device is carried out by producing a response which is required in the imaging device, and transmitting the produced response to the imaging device.

3. The microchip for repairing cartridge according to claim 1, wherein the communication between the microprocessor and the imaging device is carried out by memorizing information in a memory of the microprocessor in response to the commands from the imaging device.

4. The microchip for repairing cartridge according to claim 1, wherein the microprocessor has information regarding the initial 200 bits of the data signal, and also has information regarding the type of cartridge which corresponds to the initial data signal.

5. The microchip for repairing cartridge according to claim 1, wherein the microchip further comprises:

a rectifier which filters data signal from electronic signal received by the electrodes, and transfers the filtered data signal to the microprocessor;

a reference voltage generator which generates a reference voltage, and provides the reference voltage to the microprocessor, wherein the reference voltage is used to discard the data signal which has the smaller amplitude than the reference voltage; and a voltage generator which generates an operation voltage for the microprocessor and the microprocessor programming terminal by using the electronic signal rectified in the rectifier.

6. A method for repairing a cartridge, comprising:

installing a cartridge, on which a repairing microchip is mounted, in an imaging device, and initializing a main processor of the imaging device;

detecting (a) a clock generation time and (b) a clock frequency of an clock signal transferred from the imaging device;

determining a type of cartridge which is compatible with the imaging device from the detected (a) the clock generation time and (b) the clock frequency, wherein the determined type of cartridge is recorded in a memory of the microchip; and carrying out communication between the microchip and the imaging device with a communication program which corresponds to the determined type of cartridge in order to make the cartridge to be compatible with the imaging device.

* * * * *